US008308511B2

(12) United States Patent
Zhang

(10) Patent No.: US 8,308,511 B2
(45) Date of Patent: Nov. 13, 2012

(54) WATERPROOF ELECTRICAL CONNECTOR

(75) Inventor: Wei-De Zhang, Shenzhen (CN)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 0 days.

(21) Appl. No.: 13/152,348

(22) Filed: Jun. 3, 2011

(65) Prior Publication Data

US 2011/0300756 A1 Dec. 8, 2011

(30) Foreign Application Priority Data

Jun. 4, 2010 (CN) ..... 2010 2 0213342

(51) Int. Cl.
*H01R 13/648* (2006.01)

(52) U.S. Cl. ..... 439/607.01

(58) Field of Classification Search ..... 439/625, 439/607.01, 620.1, 939, 668, 620.12
See application file for complete search history.

(56) References Cited

U.S. PATENT DOCUMENTS 6,190,205 B1 * 2/2001 Wu ..... 439/607.34
7,044,791 B2 * 5/2006 Wang ..... 439/607.35

FOREIGN PATENT DOCUMENTS

TW M296526 8/2006

* cited by examiner

*Primary Examiner* — Jean F Duverne
(74) *Attorney, Agent, or Firm* — Ming Chieh Chang; Wei Te Chung

(57) ABSTRACT

An electrical connector comprises: a lower insulative housing with several terminal slots each comprising a sink communicating to exterior; an upper insulative housing assembled on the lower insulative housing to define a receiving room for receiving an audio plug, the upper insulative housing comprising several terminal slots corresponding to those of the lower insulative housing and an extension plate extending toward the sink of the lower insulative housing; a number of terminals each comprising a main body, a resilient arm and a solder tail extending from the main body, the main bodies of the terminals retained in cooperating terminal slots of the lower and upper insulative housing inwardly of the sinks of the lower insulative housing and the extension plates of the upper insulative housing; and a fastening member combining the upper and lower insulative housings as an integrating unit.

13 Claims, 4 Drawing Sheets

WATERPROOF ELECTRICAL CONNECTOR

FIELD OF THE INVENTION

The present invention generally relates to an electrical connector, and more particularly to an audio jack type connector with waterproof structures.

DESCRIPTION OF RELATED ART

Nowadays, portable devices such as a mobile phone or MP3 are ubiquitous. Usually, peripheral surfaces of these products comprise a plurality of connectors (such as audio jack, micro USB, etc.) for transmitting power and signal. In many cases, such as raining or a user's carelessness, the devices might be invaded by water through the connectors, worse still, the devices might be damaged.

Taiwan Patent No. 296526 issued on Aug. 21, 2006 discloses an audio jack connector which comprises an insulative housing with two openings in front and rear ends thereof and with several slots for receiving terminals. The audio jack connector therefore exists a plurality of small gaps communicating the exterior and the interior of the device, i.e., via the two openings and the slots. The device might be invaded by water via the small gaps as to damage internal electronic components when the device drops in water or in a humid environment.

Hence, an improved waterproof electrical connector is highly desired to overcome the aforementioned problems.

SUMMARY OF THE INVENTION

Accordingly, an object of the present invention is to provide a waterproof electrical connector.

In order to achieve the object set forth, an electrical connector comprises a lower insulative housing with several terminal slots each comprising a sink communicating to exterior; an upper insulative housing assembled on the lower insulative housing to define a receiving room for receiving an audio plug, the upper insulative housing comprising several terminal slots corresponding to those of the lower insulative housing and an extension plate extending toward the sink of the lower insulative housing; a number of terminals each comprising a main body, a resilient arm and a solder tail extending from the main body, the main bodies of the terminals retained in cooperating terminal slots of the lower and upper insulative housing inwardly of the sinks of the lower insulative housing and the extension plates of the upper insulative housing; and a fastening member combining the upper and lower insulative housings as an integrating unit.

Other objects, advantages and novel features of the invention will become more apparent from the following detailed description when taken in conjunction with the accompanying drawings.

DETAILED DESCRIPTION OF PREFERRED EMBODIMENTS

Figure 1:
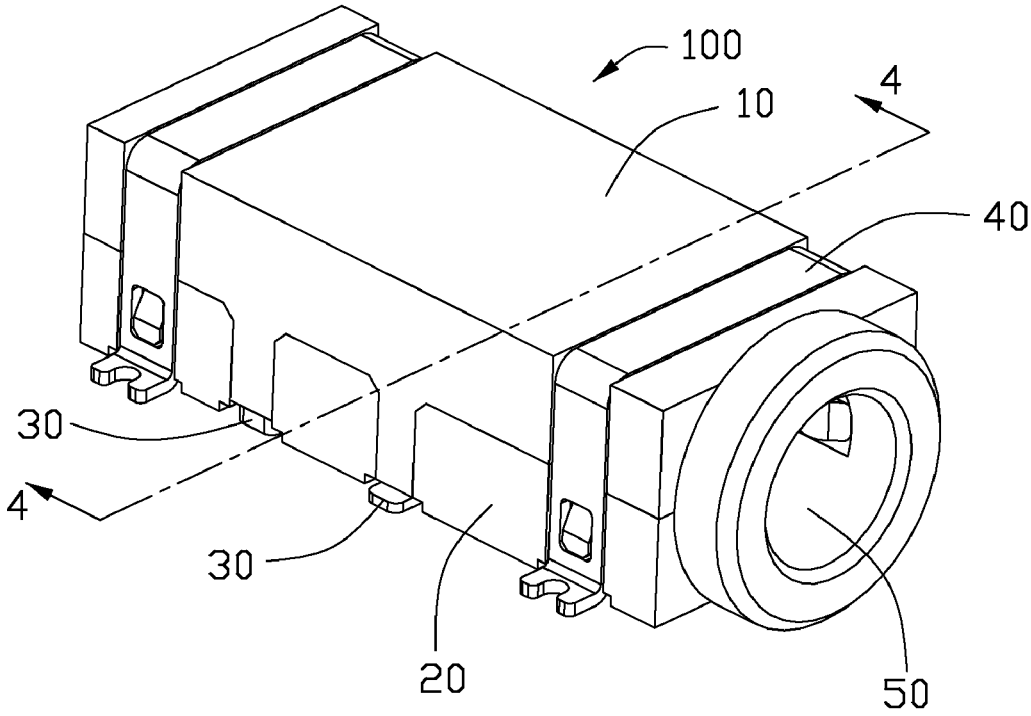
FIG. 1 is an assembled, perspective view of the electrical connector in accordance with a preferred embodiment of the present invention.

Reference will now be made in detail to the preferred embodiment of the present invention.

Referring to FIGS. 1-4, the invention is an audio jack connector 100 comprising an upper insulative housing 10, a lower insulative housing 20, a plurality of terminals 30 sandwiched by the upper and the lower insulative housings 10, 20, and a pair of fastening members 40 for integrating the two insulative housings 10, each other.

Figure 2:
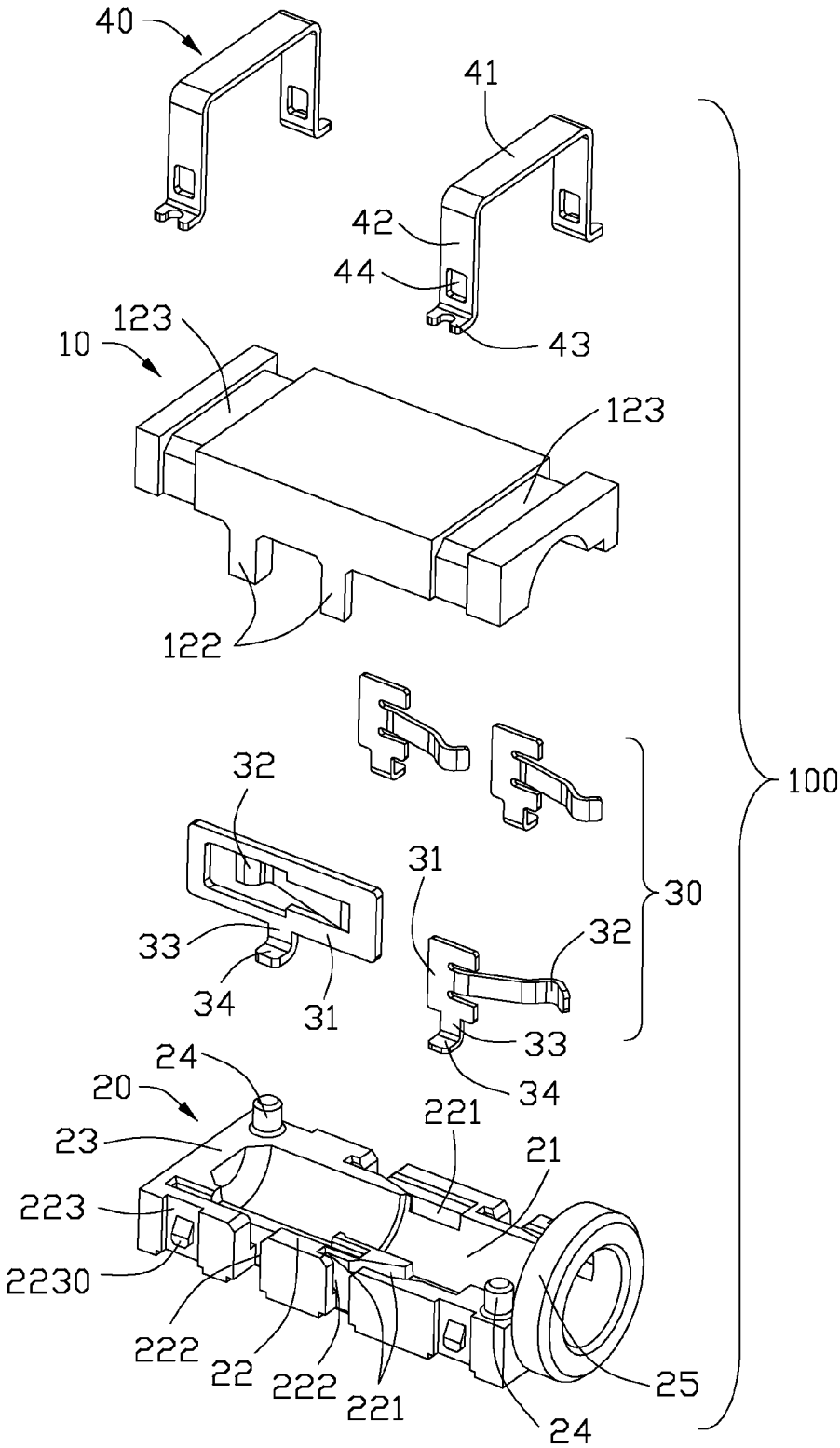
FIG. 2 is an exploded, perspective view of the electrical connector.
Figure 3:
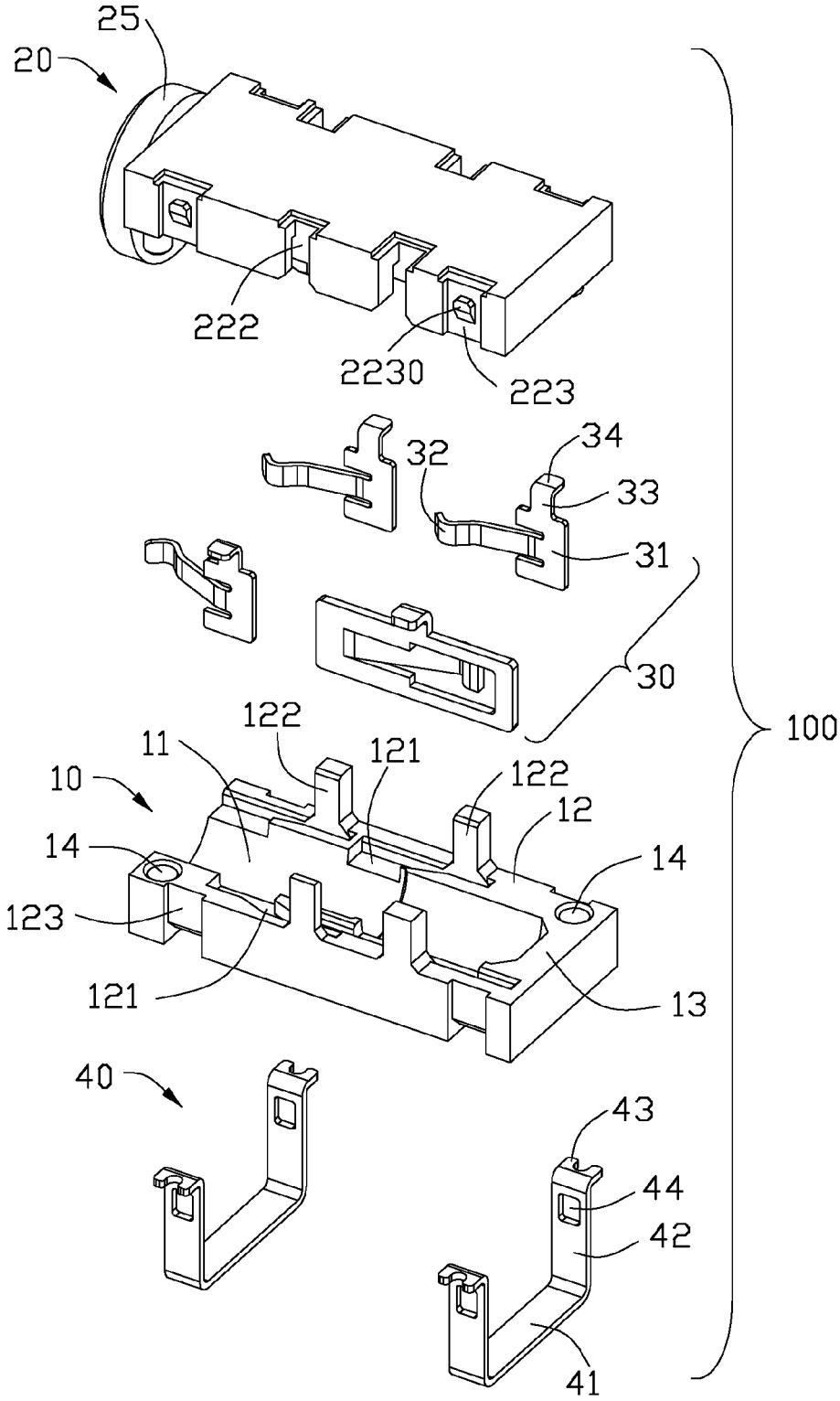
FIG. 3 is an exploded, perspective view in another direction of the electrical connector.
Figure 4:
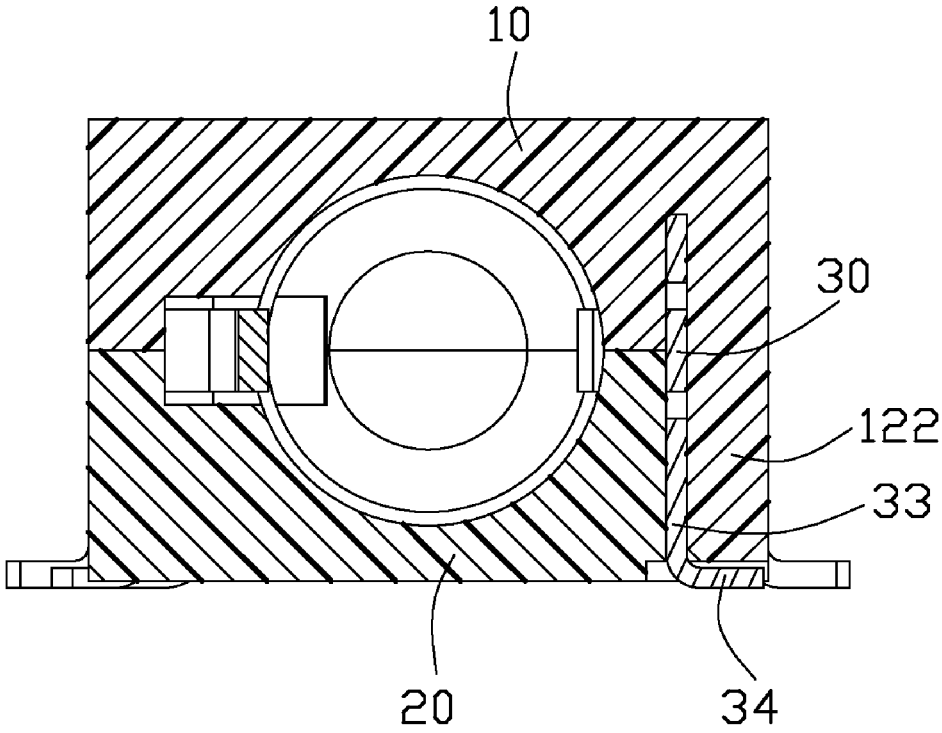
FIG. 4 is a cross-section view of FIG. 1 taken along line 4-4.

Referring to FIGS. 2-4, each terminal 30 comprises a main body 31, a resilient arm 32 and a solder tail 34 both extending from the main body 31, and a connecting portion 33 connecting the main body 31 and the solder tail 34. The connecting portion 33 is coplanar with the main body 31.

The said fastening members 40 each comprise a base portion 41, a pair of extensions 42 extending from lateral sides of the base portion 41 and a pair of solder portions 43 each formed on a distal end of the extension 42. The extension 42 comprises a latch hole 44 adjacent to the solder portion 43.

There is a receiving room 50 defined by the upper insulative housing 10 and the lower insulative housing 20 for receiving an audio plug. The receiving room 50 comprises an opening 25 on one end of the audio jack connector 100 corresponding to receive the audio plug and the other surfaces of the receiving room 50 in a closed state. The upper insulative housing 10 comprises an interior recess 11 in middle thereof, two side walls 12 and a rear wall 13. The side wall 12 comprises a plurality of terminal slots 121, several extension plates 122 extending from the side wall toward the lower insulative housing 20 and two retention slots 123 defined on exterior surface of the upper housing 10. Two position holes 14 are defined in two diagonal corners of the rear wall 13 and opening 25.

The lower insulative housing 20 comprises at an interior thereof a recess 21 (generally semicircular in cross-section), two side walls 22 and a rear portion 23 corresponding to the upper insulative housing 10. The side wall 22 comprises a plurality of terminal slots 221 communicating with the bottom surface of the housing 20. Several sinks 222 are defined on the surface of the side wall 22 to receive corresponding extension plates 122 of the upper housing 10. Exterior surface of each side wall 22 defines two retention slots 223 cooperating with the retention slots 123 of the upper housing 10 to receive the fastening members 40. A block 2230 is formed in the retention slot 223 of the lower housing 20 to engage with the latch hole 44 of the fastening member 40. The lower housing 20 comprises two positioning posts 24 corresponding to the position hole 14 of the upper housing 10.

Following will be made in detail to introduce the assembling method of the electrical connector 100. Firstly, the terminals 30 are assembled in the terminal slots 221 of the lower housing 20, the resilient arm 32 revealed in the receiving room 50, lower section of the main body 31 of the terminal 30 retained in the slots 221 and the connecting portion 33 locating in the sink 222. Secondly, the upper housing 10 assembles on the lower housing 20 and forms the receiving room 50 by the interior recess 11, 21 of upper housing 10 and the lower housing 20. The positioning posts 24 of the lower housing 20 are retained in the position hole 14 of the upper housing 10. Upper section of the main body 31 of the terminal 30 is retained in the terminal slot 121 of the upper housing 10. The extension plate 122 of the upper housing 10 inserts into the sink 222 and make the connecting portion 33 of the terminal 30 locating between the extension plate 122 and the housing 20 to keep the receiving room 50 from the exterior to avoid leaking. Width of the connecting portion 33 of the terminal 30 (or section of the main body 31 which is in the sink 222), the sink 222 of the lower housing 20 and the extension plate 122 of the upper housing 10 are equivalent. Finally, the upper housing 10 and lower housing 20 are integrated by the fastening members 40 assembled in the retention slots 123, 223 of the housing 10, 20. The block 2230 of the lower housing 20 is retained in the latch hole 44 to integrate the upper and lower housing 10, 20.

The present invention electrical connector 100 comprises two insulative housings 10, 20, the terminal 30 inserting into the lower insulative housing 20 firstly, and then, the upper insulative housing 10 assembled on the lower insulative housing 20 to make the terminal 30 in the upper and lower housing 10, 20 and the terminal slots 121, 221 in an airtight state via the extension plate 122 of the upper housing 10 cooperating with the sink 222 of the lower housing 20 to clip the connecting portion 33 of the terminal 30.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector comprising:

a lower insulative housing comprising several terminal slots, each of the slots comprising a sink communicating to exterior;

an upper insulative housing assembled on the lower insulative housing to define a receiving room for receiving an audio plug, the upper insulative housing comprising several terminal slots corresponding to those of the lower insulative housing and several extension plates received in the sinks;

a plurality of terminals each comprising a main body, a resilient arm and a solder tail both extending from the main body, the terminals being retained in the terminal slots of the upper and lower insulative housings, the main body being located around the sink of the lower insulative housing and sealingly pressed by the extension plate of the upper insulative housing; and a pair of fastening members combining the upper and lower insulative housings as an integrating unit, the extension plates being located between the pair of fastening members.

2. The electrical connector as recited in claim 1, wherein the upper insulative housing and the lower insulative housing each comprise an interior recess which jointly forms the receiving room with an opening to receive an audio plug and with other surfaces of the receiving room being in a sealed state.

3. The electrical connector as recited in claim 1, wherein the fastening member comprises a base portion, two extensions extending from two ends of the base portion, two solder portions on two free ends of the extensions, and a latch hole in the extension adjacent to the solder portion.

4. The electrical connector as recited in claim 3, wherein each of the upper and lower insulative housings comprises a retention slot on an outer surface thereof for receiving the fastening member.

5. The electrical connector as recited in claim 4, wherein the retention slot of the lower insulative housing comprises a block to clip with the latch hole of the fastening member.

6. The electrical connector as recited in claim 1, wherein the terminal comprises a connecting portion for connecting the solder tail and the main body, the connecting portion constituting a section of the main body.

7. The electrical connector as recited in claim 6, wherein the connecting portion of the terminal is located in the sink of the lower insulative housing and is pressed by the extension plate of the upper insulative housing so that the sink is in a sealed state to prevent water from entering.

8. The electrical connector as recited in claim 7, wherein widths of the connecting portion of the terminal, the sink, and the extension plate are substantially equal.

9. The electrical connector as recited in claim 8, wherein the resilient arm is exposed in the receiving room to contact an inserted audio plug and the solder tail is exposed to exterior.

10. The electrical connector as recited in claim 1, wherein the lower insulative housing comprises two positioning posts on two diagonal corners thereof, and the upper insulative housing comprises two positioning holes receiving the positioning posts of the lower insulative housing.

11. An electrical connector comprising:

a first insulative housing and a second insulative housing assembled to each other to commonly define a receiving cavity therein;

the first insulative housing defining a mounting surface and a mating surface opposite to the mounting surface, a plurality of passageways running through the mounting and mating surfaces, and a plurality of sinks each communicating with a corresponding passageway;

the second insulative housing comprising a plurality of extension plates extending toward the mounting surface of the first insulative housing and located in corresponding sinks; and a plurality of terminals retained in the passageways and having contact sections extending into the receiving cavity; wherein the sinks extend through the mounting and mating surfaces of the first insulative housing, and the extension plates respectively abut against corresponding terminals.

12. The electrical connector as claimed in claim 11, wherein each of the terminals comprises a main body, a solder tail extending perpendicularly from the main body and said contact section extending from the main body, the solder tail is located at a bottom of a corresponding sink, and the extension plate is aligned with the solder tail.

13. The electrical connector as claimed in claim 12, wherein the solder tails are substantially coplanar with the mounting surface of the first insulative housing, and the extension plates of the second insulative housing are located above and adjacent to the solder tails.

* * * * *